United States Patent [19]

Pine et al.

[11] Patent Number: 4,473,441

[45] Date of Patent: Sep. 25, 1984

[54] APPARATUS FOR HEAT INDUCED SEPARATION OF HYDROCARBON CONSTITUENTS FROM COAL

[75] Inventors: MacDonald Pine; James R. Johnson, both of Springfield; Rudolph A. Sandoval, Cantrall; Ronald E. Moss, Jacksonville, all of Ill.

[73] Assignee: Carbon Dynamics, Inc., Springfield, Ill.

[21] Appl. No.: 473,806

[22] Filed: Mar. 9, 1983

[51] Int. Cl.[3] ..... C10B 1/04; C10B 27/00; C10B 37/00

[52] U.S. Cl. ..... 202/104; 202/117

[58] Field of Search ..... 202/99, 104, 117, 124, 202/221; 201/27, 33; 44/2; 432/102, 129, 132

[56] References Cited

U.S. PATENT DOCUMENTS

| | | | |
|---|---|---|---|
| 1,384,878 | 7/1921 | Wingett | 202/117 |
| 1,558,974 | 10/1925 | Freeman | 202/117 |
| 1,649,195 | 11/1927 | Roth | 202/117 |
| 1,706,421 | 3/1929 | Trent | 202/117 |
| 2,182,750 | 12/1939 | Pope | 202/104 |
| 4,100,032 | 7/1978 | Elberg | 201/27 |

FOREIGN PATENT DOCUMENTS

| | | | |
|---|---|---|---|
| 944309 | 3/1974 | Canada | 202/104 |

*Primary Examiner*—Bradley Garris

*Attorney, Agent, or Firm*—Gunn, Lee & Jackson

[57] ABSTRACT

A method and apparatus is provided for accomplishing thermal separation of various hydrocarbons and other compounds from coal, a hydrocarbon rendering module is provided for the continuous agitation and circulation of coal during the rendering period and utilizes thermal trays having stationary and revolving apparatus to improve heat transfer to coal particles and minimize rendering time. Portions of the rendered hydrocarbon products are recycled to the mechanism as an energy source for continuous operation.

14 Claims, 5 Drawing Figures

APPARATUS FOR HEAT INDUCED SEPARATION OF HYDROCARBON CONSTITUENTS FROM COAL

FIELD OF THE INVENTION

This invention relates generally to methods and apparatus for thermal processing of coal to derive solid, liquid and gaseous hydrocarbon constituents therefrom. More specifically, the present invention relates to a method and apparatus for accomplishing continuous agitation and distribution of coal particulate during a processing period wherein cool particulate is transferred in serial manner through a series of vertically arranged coal handling trays to accomplish efficient heat induced separation and collection of the various hydrocarbon constituents therefrom.

BACKGROUND OF THE INVENTION

For many years, coal has been utilized as a source of fossil fuel for accomplishing heating. It is well known that direct utilization of coal particulate for heating purposes results in waste because large amounts of hydrocarbon constituents contained in the coal are lost due to improper combustion. Various apparatus has been developed over the years to assist in accomplishing more efficient combustion to thereby minimize energy losses of the coal.

It is also well known that coal contains gaseous, liquid and solid hydrocarbon constituents, each having specific value in industrial applications. Processing systems have been developed for the purpose of separating these gaseous, liquid and solid constituents but, for the most part, these processes and the apparatus performing the processes are of relatively inefficient nature. It is therefore desirable to provide a method and apparatus for accomplishing separation of gaseous, liquid and solid hydrocarbon constituents wherein the method and apparatus utilized function substantially automatically to accomplish efficient separation.

SUMMARY OF THE INVENTION

It is therefore a primary feature of the present invention to provide a novel method and apparatus for separation of hydrocarbon constituents from coal which accomplish efficient separation and capture of virtually all of the gaseous, liquid and solid constituents.

It is also a feature of this invention to provide a novel method and apparatus for the rendering of coal for its various constituents wherein coal particulate is efficiently distributed and agitated during processing in rendering modules to thereby ensure efficient heat transfer to the coal particulate to thereby accomplish efficient liberation of its constituents.

It is also a feature of this invention to provide a novel method and apparatus for rendering coal wherein coal particulate is preheated by the thermal effluent of coal modules thereby ensuring efficient liberation of its constituents immediately upon continuous depositing of the coal particulate within the modules.

Among the several features of this invention is contemplated the provision of a novel method and apparatus for rendering coal for its various constituents wherein a portion of the liberated gas of the coal is filtered and transported to a burner system for the thermal modules, thereby minimizing the need for external fuel sources for development of processing heat.

It is an even further feature of this invention to provide a novel method and apparatus for thermal processing of coal for its various hydrocarbon constituents wherein coal particulate is caused to descend by gravity through thermal modules, thereby minimizing mechanization and the consequent cost of such coal processing.

It is another feature of this invention to provide a novel method and apparatus for thermal processing of coal which is of efficient nature, is reliable in use and low in cost.

Other and further objects and features of this invention will become apparent to one skilled in the art upon consideration of this entire disclosure, including this specification and the annexed drawings. The form of the invention, which will now be described in detail, illustrates the general principles of the invention, but it is to be understood that this detailed description is not to be taken as limiting the scope of the present invention.

Briefly, the present invention involves a method of accomplishing thermal processing of coal particulate for the purpose of deriving and capturing solid, liquid and gaseous hydrocarbon constituents therefrom. These captured liquid gaseous and hydrocarbon constituents may then be stored and utilized in any suitable manner. Coal particulate is transferred by any suitable conveyor mechanism into an overhead hopper of a thermal coal processing module. The overhead hopper is located within a warm air jacket, thereby enclosing the hopper within a heated space with heat being transferred as effluent exhaust from the thermal module itself. Since the coal is preheated in the overhead hopper before it actually enters the thermal module, a reasonably small amount of additional heat within the thermal module will begin actual derivation of the hydrocarbon constituents from it. The preheating feature permits initiation of constituent liberation as soon as the coal particulate descends into the processing module. After being preheated, the coal particulate is transferred from the hopper into the first of a series of vertically oriented trays, each tray having a rotatable support plate being rotated by a vertically oriented plate support and drive unit. Each of the vertically oriented trays also incorporates fixed vertical separators oriented in spiral relation such that the coal particulate is caused to traverse a spiral path on the support plate during processing on that particular tray. The vertical separators of the trays are alternated such that the coal particulate traverses a spiral path in opposite radial directions on each succeeding tray. During traversal of the spiral paths of the trays, the coal particulate is agitated as it is moved by the rotating support plates against the fixed spiral vertical separators. This agitation causes each particle of the coal to be efficiently heated so that the gaseous, solid and liquid constituents are efficiently separated. After the last rotating thermal plate or disk has been traversed by the particulate material, the solid residue descends by gravity to an air quenching station where it is cooled somewhat and it is then transferred to a cooling and storage facility where it remains until it is disposed of. The gaseous and liquid constituents liberated from the coal are collected by exhausts at the vicinity of each of the rotating thermal disks. Collection conduits then conduct the liberated gas and water in vapor form to a condenser where the liquid constituents condense out and descend by gravity to a liquid storage facility. The gaseous constituents are then passed through a filter system and are removed by vacuum from the filter system and transferred to a flow valve for further handling. The flow valve is provided with a thermal coupler which energizes a solenoid, or any other suitable control system, thereby selectively controlling the position of the flow valve as required by the thermal coupler. A portion of the gaseous constituents of the coal are conducted to a burner system for the thermal module to thereby provide the thermal module with heat for its continuous operation. The collected gaseous material not needed for operation of the burner system is then caused to bypass the flow valve where it is conducted by a bypass line to a suitable gas storage area.

A primary startup fuel system is provided which is also in communication with the flow valve system and which provides a source of gas for start-up and initial operation of the burner system until the volume of liberated gas from the thermal module equals or exceeds the requirements of the burner system. Upon this occurrence, the primary startup fuel system will be shut down by the flow valve system and operation of the burner system of the thermal module will then be contained solely with gas liberated from the coal being processed. The coal processing system is therefore selfenergized after having been started up by an outside fuel source. The outside fuel source also functions as a source of additional fuel in the event such is required for efficient operation of the burner system.

BRIEF DESCRIPTION OF THE DRAWINGS

So that the manner in which the above-recited features, advantages and objects of the present invention are attained and can be understood in detail, more particular description of the invention briefly summarized above may be had by reference to the embodiment thereof which is illustrated in the appended drawings, which drawings form a part of this specification.

It is to be noted, however, that the appended drawings illustrate only a typical embodiment of the invention and are therefore not to be considered limiting of its scope, for the invention may admit to other equally effective embodiments.

In the Drawings:

FIG. 1 is a cross-sectional view of a hydrocarbon rendering module constructed in accordance with the present invention and having flow arrows indicating the flow of heating exhaust gases, collected gases and gravity flow of coal particulate.

FIG. 2 is a transverse sectional view taken along line 2—2 of FIG. 1 and showing the internal structural components of the module in a plan view.

Figure 3A:
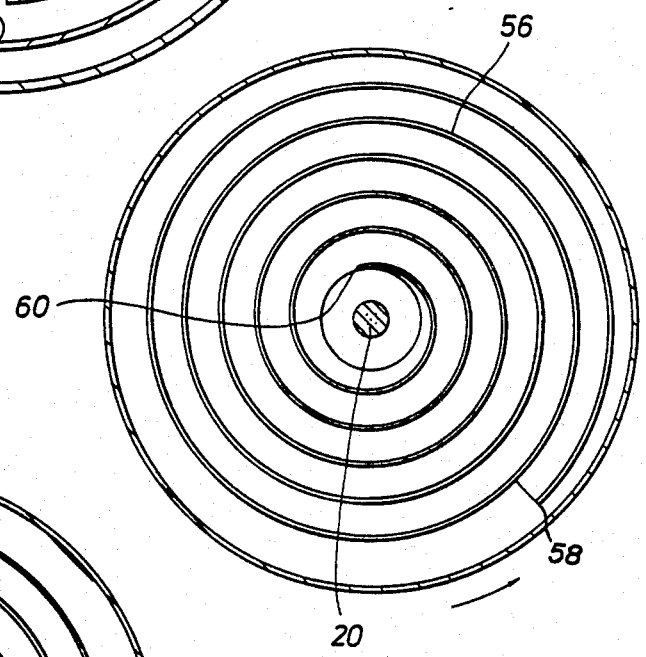

FIG. 3*a* is a plan view of a thermal tray illustrating vertical separators causing the coal to traverse a spiral path from the outer portion of the rotatable thermal disk to the central portion thereof.

Figure 3B:
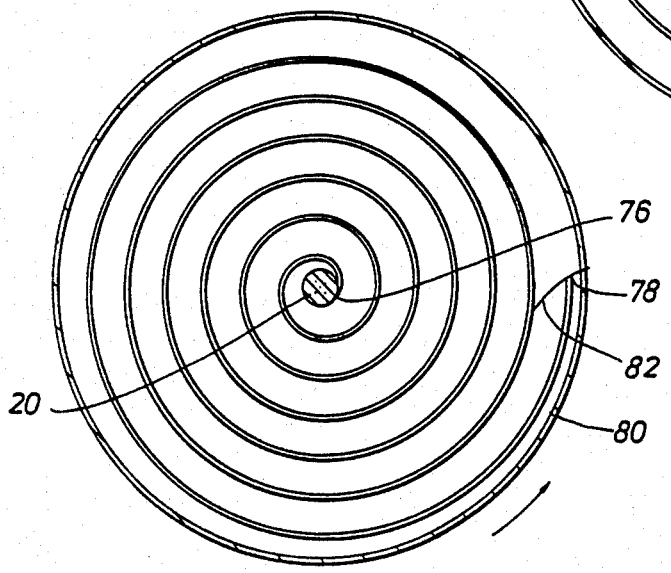

FIG. 3*b* is a plan view of a thermal tray having vertical separators causing the coal particulate to traverse a spiral path from the central portion of the rotatable thermal disk to the outer periphery thereof.

Figure 4:
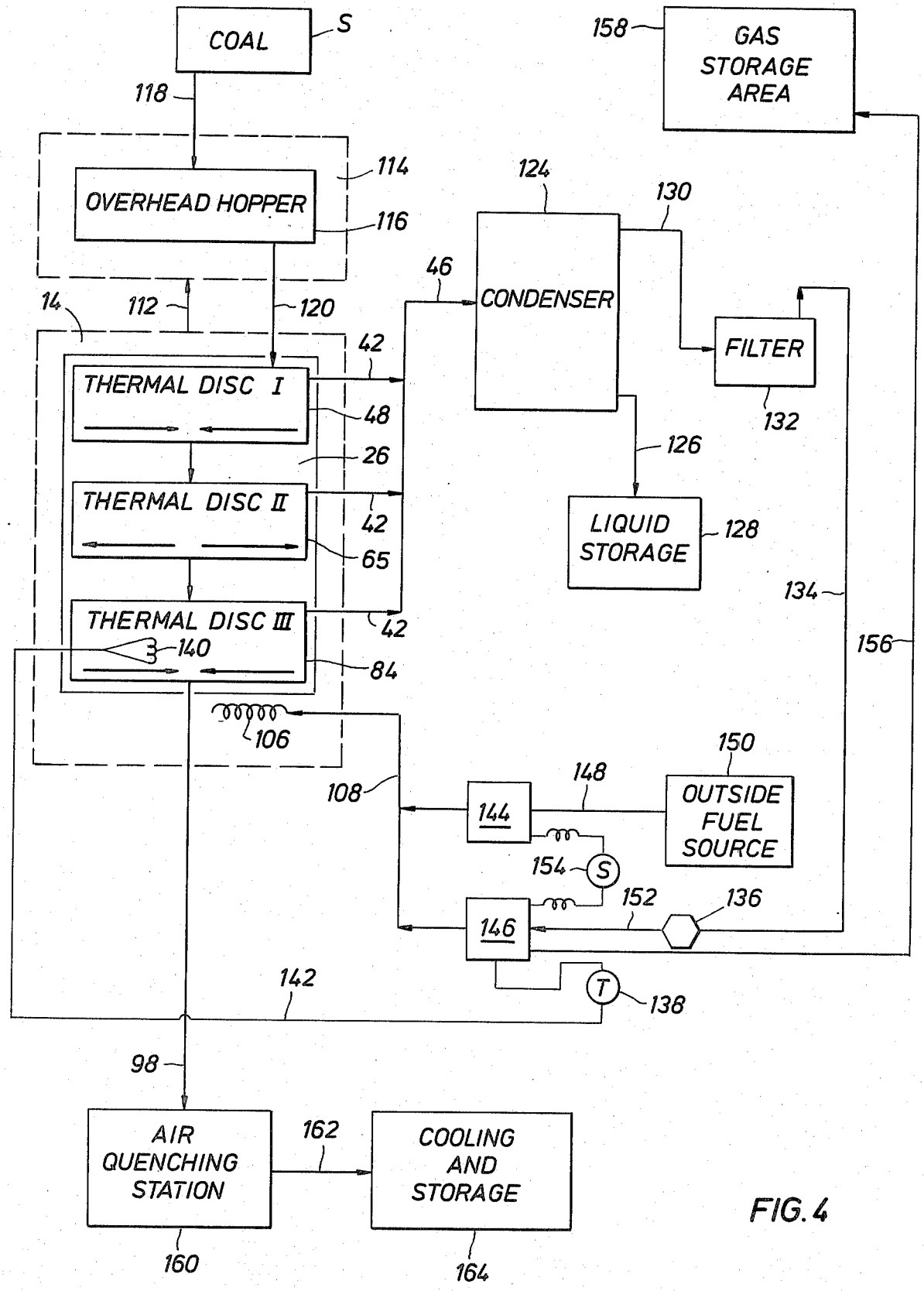

FIG. 4 is a schematic illustration of a coal rendering process constructed in accordance with the present invention and having flow arrows indicating the direction of flow of liquid, gaseous and solid constituents.

DETAILED DESCRIPTION OF PREFERRED EMBODIMENT

Figure 1:
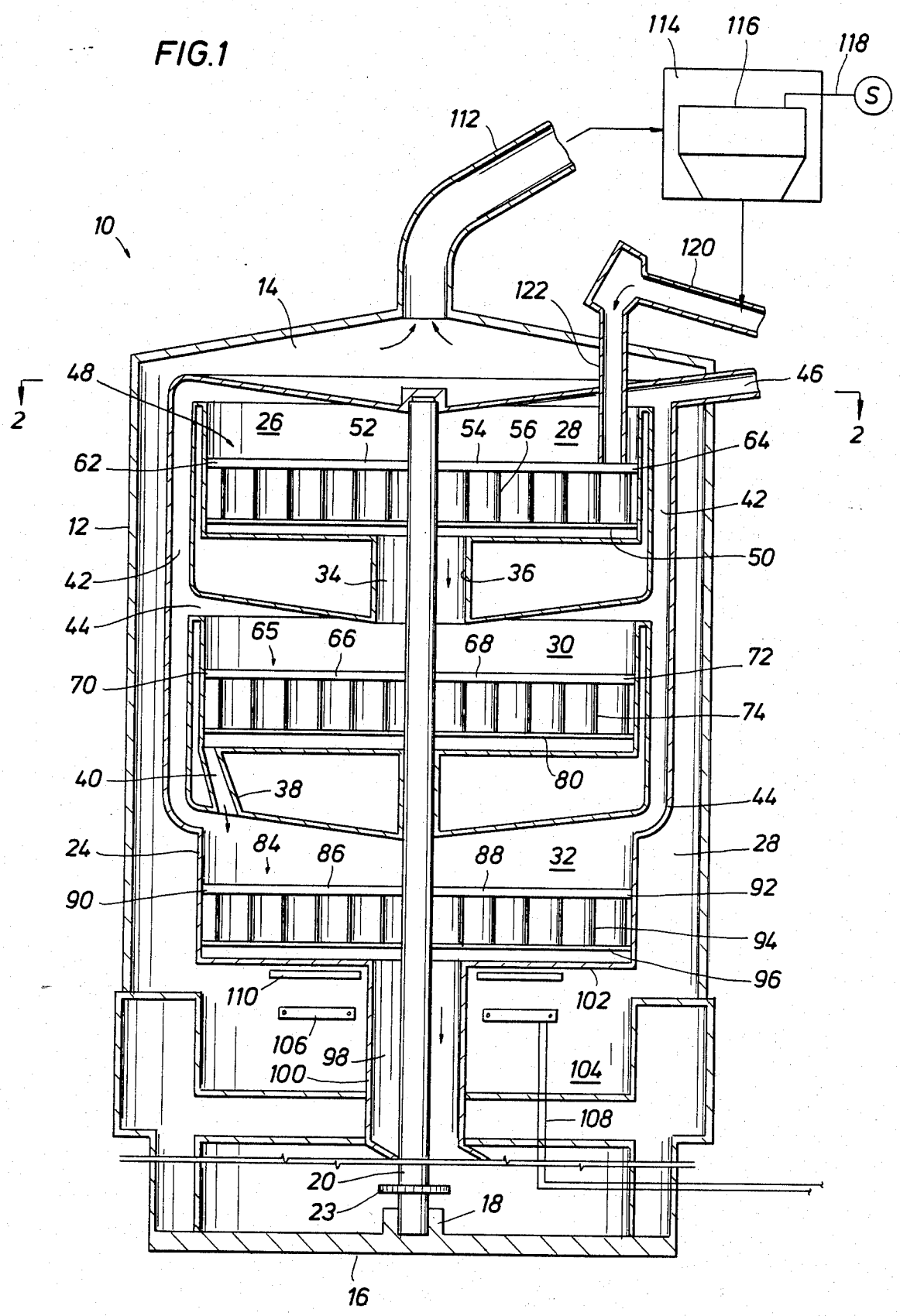
Figure 2:
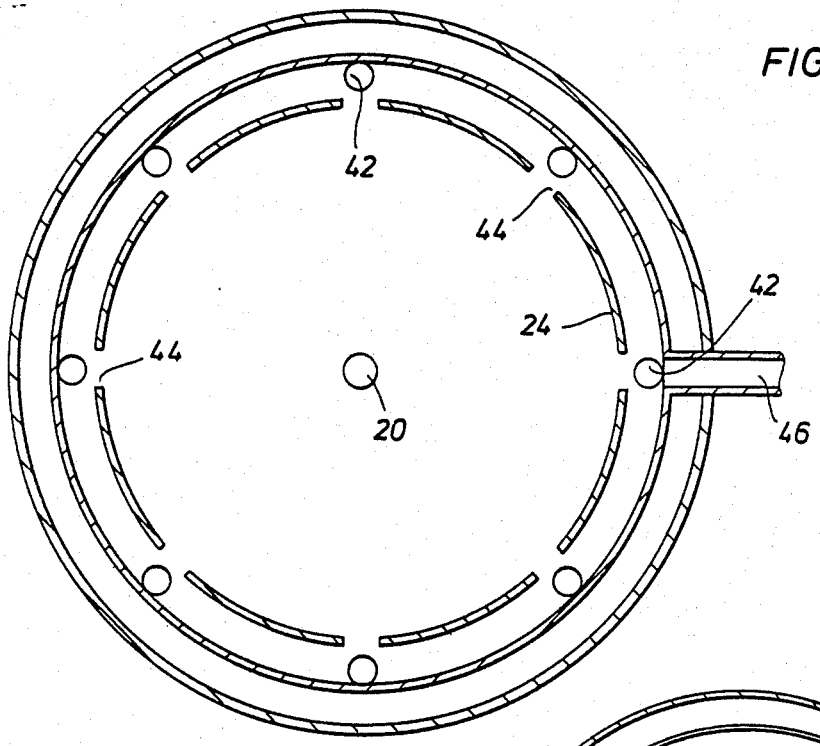

Referring now to the drawings and first to FIG. 1, a hydrocarbon rendering module is illustrated generally at 10 which includes an outer housing structure 12 which defines a thermal chamber 14 within which coal particulate is processed. The lower portion of the housing 12 defines a structural base 16 which provides a journal 18 for a rotatable drive support 20. Drive means 23 of any suitable character is interconnected with the drive support to accomplish rotation of the drive support. Within the outer housing structure 12 is provided an inner housing structure 24 defining a heating chamber 26 which is isolated from the heating chamber 14. The peripheral space between the inner and outer housings 12 and 14 defines an exhaust manifold 28 through which heated gases are passed in order to accomplish efficient heating of the inner housing 24 and the inner heating chamber 26. The inner heating chamber 26 of the inner housing 24 is divided by structural members into a plurality of thermal chambers 28, 30 and 32 with heating spaces of the heating chamber 14 circulating heated air past the surfaces of the thermal chambers in order to accomplish heating of the coal particulate contained therein. Thermal chamber 28 is in communication with thermal chamber 30 by means of a centrally disposed passage 34 defined by a generally cylindrical wall 36. Coal particulate within thermal chamber 28 after having been fully processed, is moved from the outer periphery of the support disk to the central portion thereof and will descend by gravity through the passage 34 into the thermal chamber 30. The inner housing 24 also defines wall structure 38 forming a peripheral coal transfer passage 40 through which coal particulate is allowed to descend by gravity from the thermal chamber 30 to thermal chamber 32 after having been fully processed within the intermediate thermal chamber. The thermal chambers 28, 30 and 32 are also communicated by means of collection manifold conduits 42 which communicate with exhaust ports 44 located at the upper outer periphery of each of the thermal chambers. Exhaust manifold conduits 42 conduct gases and vapors liberated from the coal particulate to a collection line 46 which transports the gases and vapors to a condenser shown in the schematic diagram of FIG. 4.

It is desirable to ensure that coal particulate entering the respective thermal chambers 28, 30 and 32 is efficiently heated in order that the liquid, gaseous and solid constituents thereof may be efficiently separated. To accomplish this feature, hydrocarbon rendering module 10 incorporates a plurality of vertically oriented trays which are located respectively within the thermal modules and which accomplish efficient agitation and distribution of the coal particulate during processing in each thermal chamber. As shown in FIG. 1, an upper coal processing tray is illustrated generally at 48 which incorporates a rotatable thermal disk 50 being secured in nonrotatable relation with the rotatable drive shaft 20.

Within the thermal chamber 28 is disposed a plurality of structural supports 52 and 54 to which is secured a vertical separator element 56 in depending relation. The vertical separator element 56 is best seen in FIG. 3*a* and is defined by a spiral vertically oriented wall which spirals from a point 58 near the outer periphery of the thermal disk 50 to a point 60 at a position near the vertical support post 20. The structural members 52 and 54 are secured at the outer extremities 62 and 64 thereof to the wall structure of the inner housing 24. The vertical separator element, therefore, is fixed in position within the inner housing and functions to guide, agitate and conduct coal particulate radially inwardly as the thermal disk 50 rotates with the wall supported on it. The coal is therefore conducted radially inwardly toward the support post member 20 until it descends by gravity through the passage 34 from the thermal chamber 28 to thermal chamber 30. During traversal of the spiral path in the first thermal tray a portion of the gases and vapors are liberated from the coal.

Within the intermediate thermal chamber 30, transverse structural support members 66 and 68 are positioned with the outer extremities 70 and 72 thereof secured in fixed relation to the wall structure of the inner housing 24. A vertical separator element 74 is supported in fixed relation within the thermal chamber 30 by the transverse support members. The vertical separator element 74 is of the form shown in FIG. 3*b*. The vertical separator is of spiral form, spiraling from an inner extremity 76 substantially engaging the vertical support post 20 and terminating at an outer extremity 78 positioned adjacent the outer peripheral portion of a second rotatable thermal support disk 80 which is also nonrotatably secured to the support post. Coal particulate descending by gravity from the upper thermal chamber 28 into the intermediate thermal chamber 30 will fall onto the thermal support disk 80 at the radial inner portion thereof adjacent the support shaft 20. As the thermal disk 80 rotates in the direction of the arrow shown in FIG. 3*b*, in the same direction of rotation as compared to the support disk 50 shown in FIG. 3*a*, the coal particulate will be conducted radially outwardly toward the outer periphery of the support disk. The vertical separator element 74 will function to agitate the coal particulate and distribute as well as convey it radially outwardly on the support disk. During such movement, the coal particulate will be continuously agitated by the cooperative relatively moving activity of the fixed vertical separator and moving support disk, thereby ensuring that the particles of coal are adequately heated during processing to thus induce liberation of the gaseous and liquid constitutents therefrom. After the coal particulate has reached the outer periphery of the support disk 80, it will be swept into the gravity flow opening 40 by a curved sweeping wall 82 having a reverse curvature as compared to the curvature of the vertical separator 74.

The coal particles will thus descend through the gravity flow passage 40 onto the outer periphery of the processing tray assembly illustrated generally at 84, which is located within the lower thermal chamber 32. The tray assembly 84 will be of essentially identical character as compared to the tray assembly 48 in thermal chamber 28. It incorporates transverse support members 86 and 88 which are fixed at the outer extremities 90 and 92 thereof to the wall structure of the inner housing 24. A spiral vertical separator element 94 is securd to the transverse structural members 86 and 88 with its lower portion diposed in close proximity with a rotatable thermal disk 96. The disk 96, like disks 50 and 80, is secured to the vertical support post 20 and rotates along with it. As particulate material descends through the passage 40 from the thermal chamber 30 to the thermal chamber 32, it becomes deposited at the outer peripheral portion of the rotatable thermal disk 96. As the disk 96 rotates in the same direction as disks 50 and 80, the coal particulate deposited on the lower thermal disk will be caused to move in spiral manner radially inwardly toward the support post 20. As the coal particulate approaches the support post, the gas and vapor liberation process will have been completed, leaving a residue of solid particulate. The solid particulate is then discharged from the support plate 96 and descends by gravity through an annular passage 98 defined by a tubular wall 100 having its upper extremity connected to the lower wall 102 of the inner housing. The lower portion of the outer housing 12 defines a burner chamber 104 having disposed therein a gas fired burner 106 which is in communication with a gas supply conduit 108. Above the burner element 106 is disposed a deflector plate 110 which functions to evenly distribute the heat from the burner about the lower portion of the inner housing 24. Heat from the burner then flows upwardly by convection about the lower portions of the intermediate thermal chamber 30 and the upper thermal chamber 28. The heated air then is conducted from the heating chamber 14 by way of an exhaust stack 112. All or a portion of the exhausted heated air from the stack 112 is conducted to a preheating chamber 114 containing a hopper 116 within which coal particulate is deposited for preheating. The coal particulate may be fed into the hopper 116 from any suitable source S by means of a conveyor or other coal transporting system 118. After the coal is preheated within the hopper 116, it descends onto a conveyor 120 which conducts the preheated coal particulate to a feed chute 122 which in turn deposits the coal on the outer periphery of the upper thermal disk 50.

Referring now to to FIG. 4, a schematic illustration is depicted which identifies the specific arrangement of structural parts and the method disclosed herein for heat processing of coal particulate. From a source S of coal particulate, a conveyor or gravity delivery system is provided to conduct coal to the hopper 116. The hopper 116 is located within a preheating chamber 114 which is fed with heat by the exhaust 112 exiting from the heating chamber 14. After being preheated, the coal particulate is conducted to the upper tray 48 of the processing system within the heating chamber 14. After being heated and processed by the upper tray 48, the coal particulate descends to the center portion of coal processing tray 65, after which it descends by gravity from the outer periphery of tray 65 to the outer periphery of the lower tray 84. Manifold exhaust lines 42 conduct effluent gases, including gas and vapor constituents to a manifold conduit 46 and thence to a condenser unit 124. The condensed liquid constituents of the coal then descend by gravity in the condenser unit 124 and exit by way of a collector line 126 to a liquid storage chamber 128. The gaseous costituents of the effluent exit the condenser unit 124 via conduit 130 which conducts the gas to a filter unit 132 that in turn filters out any undesirable solid and liquid constituents that might have been incorporated in the discharge of the condenser unit 124. The acceptable hydrocarbon gases are then conducted by a vacuum line 134 to a control point 136 where they are available for introduction into the burning unit 106. The flow of gases into the burning unit is controlled by preset thermal coupler 138 having a thermocouple element 140 within the inner heating chamber 26 and interconnected to the thermal coupler by means of a conductor line 142. A pair of gas control valves are provided as shown at 144 and 146, each having the discharge thereof interconnected with the gas supply line 108 of the burner unit 106. Control valve 144 is connected via an inlet line 148 to an auxiliary gas supply 150 which supplies gas during startup operations and during periods when additional gas is required to maintain the proper heat range within the inner heating chamber 26. The inlet of control valve 146 is connected with a supply line 152 in communication with the gas source point 136. For normal operation of the hydrocarbon rendering module, gas for operation of the burner unit 106 will be supplied via conduit 134 from the filter 132 and then through conduit 152 to the control valve 146. A solenoid 154 or other suitable control system may be employed for operation of the control valves 144 and 146.

Primary startup of the unit and pilot ignition is fueled from the auxiliary fuel source 150. The auxiliary fuel source also provides booster fuel to complement the rendered gaseous hydrocarbons when required. The filtered gas that is not required for operation of the burner system 106 is caused to bypass the control valve 146 and to be conducted via line 156 to a gas storage facility 158.

After the coal particulate has been completely processed within the three processing trays, 48, 65 and 84 of the hydrocarbon rendering module, the remaining solid particulate residue descends through the passage 98 from the lower thermal chamber 32 and is then conducted to an air quenching station 160 for preliminary cooling. The partially cooled solid coal particulate is then conducted by any suitable conveyor 162 to a cooling and storage facility 164 where it remains until finally disposed of.

Although three coal processing trays are shown in the drawings, it is not intended to limit the present invention to any particular number of coal processing trays. It is to be understood that any number of coal processing trays may be employed without departing from the spirit and scope of the present invention.

From the foregoing, it is apparent that the present invention sets forth a coal processing system and apparatus therefor which is specifically organized to accomplish efficient separation of solid, liquid and gaseous constituents from coal particulate. Moreover, it is apparent that the simplicity of the hydrocarbon rendering module effectively promotes the development of a coal processing system which is of simple, low-cost nature. Its simplicity also effectively promotes its serviceability and low cost and thereby maximizes its competitive advantage in the market. The gaseous, liquid and solid constituents of coal particulate may therefore be efficiently separated at low-cost.

While there has been shown and described a preferred embodiment in accordance with the present invention, it will be appreciated that many changes and modifications may be made therein without, however, departing from the essential spirit thereof.

Having thus described this invention in detail,

What is claimed is:

1. Apparatus for thermal separation of gaseous, liquid and solid constituents from coal particulate, comprising:

(a) a plurality of vertically oriented thermal disks;

(b) means supporting and rotating said thermal disks about a vertical axis;

(c) a plurality of vertical separator elements being statically positioned one adjacent the upper surface of each of said thermal disks, said separator elements being arranged in serial, alternating inwardly spiraling and outwardly spiraling relation and causing coal particulate resting on said rotating thermal disks to be conveyed in respective inwardly spiraling paths and outwardly spiraling paths;

(d) means conducting coal particulate from upper rotating thermal disks to lower rotating thermal disks;

(e) means conducting coal particulate to the uppermost one of said rotating thermal disks;

(f) means conducting coal particulate from the lowermost one of said rotating thermal disks and discharging said coal particulate from said apparatus;

(g) inner housing means enclosing said thermal disks and vertical separator elements and defining inner heating chamber means;

(h) outer housing means enclosing said inner housing means and forming outer heating chamber means;

(i) means conducting thermally liberated gases and liquid vapors from said inner housing means and through said outer housing means; and (j) heating means disposed within said outer heating chamber means and outwardly of said inner heating chamber means.

2. Apparatus as recited in claim 1, wherein: P1 said heating means is in the form of gas burner means utilizing said liberated gaseous constituents of said coal particulate for operation of said gas burner means.

3. Apparatus as recited in claim 2, wherein:

an auxiliary source of burner gas is provided to fire said gas burner means during start up operations and during periods where said liberated gaseous constituents of said coal particulate are insufficient to maintain the desired range of heat within said outer heating chamber means.

4. Apparatus as recited in claim 3, wherein:

(a) first and second control valves respectively control the flow of gas from said liberated gaseous constituents and said auxiliary source of gas; and (b) thermal coupler means controls operation of said first and second control valves responsive to heat conditions detected in said inner heating chamber means.

5. Apparatus as recited in claim 1, including:

(a) coal hopper means;

(b) hopper discharge means conducting coal particulate from said coal hopper means to the uppermost one of said rotating thermal disks;

(c) jacket means encompassing said coal hopper means and defining a coal preheating chamber; and (d) means conducting heated air from said outer heating chamber means to said coal preheating chamber.

6. Apparatus as recited in claim 5, including: collector manifold means for conducting the discharge of liberated gaseous and liquid coal constituents from said inner heating chamber means for further processing.

7. Apparatus as recited in claim 5, wherein:

(a) said inner heating chamber means is separated into a plurality of thermal chambers, each thermal chamber enclosing one of said rotating thermal disks and one of said vertical separators, each of said thermal chambers defining collector outlet means; and including (b) collector manifold means interconnecting said collector outlet means and conducting liberated gaseous and liquid constituents from said thermal chambers, said collector manifold means extending from said thermal chambers through said outer housing means.

8. Apparatus as recited in claim 7, including:

condenser means receiving said liberated gaseous and liquid constituents of said coal particulate from said collector manifold means, said condenser means separating said liberated gaseous constituents from said liquid constituents.

9. Apparatus as recited in claim 8, including:
liquid storage means being in communication with said condenser means and receiving the separated liquid constituents from said condenser means.

10. Apparatus as recited in claim 8, including:
filter means being in communication with said condenser means and receiving said liberated gaseous constituents of said coal particulate from said condenser means.

11. Apparatus as recited in claim 10, including:
vacuum means being in communication with said filter means, said vacuum means conducting said liberated gaseous constituents from said filter means.

12. Apparatus as recited in claim 11, wherein:
(a) said heating means is defined by gas burner means; and
(b) control valve means is in communication with said vacuum means and controls the flow of said liberated gaseous constituents to said gas burner means.

13. Apparatus as recited in claim 12, including:
(a) an auxiliary source of burner gas;
(b) second control valve means being in communication with said auxiliary source of burner gas and with said gas burner means; and
(c) thermal control means controlling activation of said control valve means responsive to heat conditions within said inner heating chamber means.

14. Apparatus as recited in claim 13, wherein:
gas storage means is interconnected with said control valve means, said liberated gaseous constituents of said coal particulate not required for heating said outer heating chamber means is conducted by said control valve means to said gas storage means.

* * * * *